US007337613B2

(12) United States Patent
Bellows

(10) Patent No.: US 7,337,613 B2
(45) Date of Patent: Mar. 4, 2008

(54) METHOD FOR MONITORING AND CONTROLLING STEAM TURBINE SYSTEM PH USING SHAFT CURRENT

(75) Inventor: James C Bellows, Maitland, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 306 days.

(21) Appl. No.: 11/045,712

(22) Filed: Jan. 28, 2005

(65) Prior Publication Data

US 2006/0168964 A1 Aug. 3, 2006

(51) Int. Cl.
*F01K 13/02* (2006.01)

(52) U.S. Cl. ..... 60/660; 60/670

(58) Field of Classification Search ..... 60/660, 60/670

See application file for complete search history.

(56) References Cited

U.S. PATENT DOCUMENTS 4,365,476 A * 12/1982 Masuda et al. ..... 60/686
4,709,664 A * 12/1987 Barto et al. ..... 122/379
4,833,622 A * 5/1989 Barto et al. ..... 700/271
4,873,512 A 10/1989 Miller
5,233,499 A * 8/1993 Twerdochlib ..... 361/212
5,398,269 A * 3/1995 Nagase et al. ..... 376/306
5,992,152 A 11/1999 Weres et al.
6,397,596 B1 * 6/2002 Boyle ..... 60/597
6,672,825 B1 1/2004 Tarelin
6,698,205 B2 3/2004 Tarelin

OTHER PUBLICATIONS

Tarelin, "Electrical Method to Increase Power Output by Improving Condensation and Flow of Steam . . . ," 58th Annual Meeting of the American Power Conf., 1996, pp. 1198-1203.
Twerdochlib, "Two recent developments in monitors for large turbine generators," Sep. 1, 1998, IEEE Trans. Power Electronics; vol./Issue 3:3, pp. 653-659.

* cited by examiner

*Primary Examiner*—Hoang Nguyen

(57) ABSTRACT

The present invention involves a system for controlling the electric charge within the exhaust hood and condenser of a steam turbine by using shaft current as an indirect measurement of exhaust charge, and then adjusting the pH accordingly. The present invention uses the turbine-generator shaft 12 instead of a probe, and therefore measures the potential of the current in the shaft to the ground. This measurement 32 is then fed into a control unit 40 which adjusts the chemical feed 42 to the feedwater supply 44 of the steam turbine system.

15 Claims, 2 Drawing Sheets

METHOD FOR MONITORING AND CONTROLLING STEAM TURBINE SYSTEM PH USING SHAFT CURRENT

FIELD OF THE INVENTION

The field of the invention relates to monitoring and controlling steam turbine system pH and charge in turbine exhaust.

BACKGROUND

It is a goal in steam turbine power generation to increase power output and decrease corrosion in the exhaust hood and condenser of a power generating unit. One method of doing this is by measuring and controlling electric charge released to steam from the turbine and the various charge release regions within the exhaust hood near to the turbine as described in U.S. Pat. No. 5,992,152 by Weres.

If the amount of negative charge in the steam is large enough to produce intense electrical discharge activity, severe corrosion of carbon steel structural members and turbulence is created, which in turn decreases the power output of the generating unit. Therefore, corrosion may be controlled and power output increased by blocking the release of negative charge, such as by a small net positive charge added to the steam. However, excessive values of positive charge in the steam also have similar deleterious effects.

The amount of electric charge in the steam is a function of the amount of ammonia or another volatile base added to the feedwater. A system of automatic control which controls ammonia feed rate in response to measured charge is used to maintain charge density at a predetermined set-point which provides increased power output and decreased corrosion.

In the prior art, control probes collect the current from the control probe to ground proportional to charge density at the specific location of that probe. Correlating values of the current from the probes to ground indicate the minimum value of the current from the probe to ground needed to make the space charge throughout most of the exhaust hood and condenser positive.

Control probes, however, are an added complexity to an already complicated system. They are subject to malfunction, corrosion and by their nature need to be placed in the exhaust path, adding to turbulence. What is needed is a system for monitoring and controlling charge in the turbine exhaust moisture without use of the invasive and fragile control probes. This will increase the reliability of steam turbine power generation systems, and even increase their efficiency. Other difficulties with the prior art also exist, some of which will be apparent upon further reading.

SUMMARY OF THE INVENTION

With the foregoing in mind, methods and apparatuses consistent with the present invention include a system for controlling the electric charge within the exhaust hood and condenser of a steam turbine by using shaft current as an indirect measurement of exhaust charge, and then adjusting the pH accordingly. The systems of the prior art determine the adjustments to the pH of the feedwater by using probes placed in the path of the steam flow to measure the current as it relates to ground. The present invention uses the common shaft of the turbine and generator (hereafter referred to as the turbine-generator shaft) instead of a probe, and therefore measures the potential of the current in the shaft to the ground.

The shaft current is created by the ions in the exhaust generated by shearing the double layer on the turbine surfaces, creating charged moisture droplets. The charges on the moisture droplets depend on the surface chemistry and are often positive, with the corresponding negative charge remaining on the rotor. This current is used to optimize the addition of ammonia or other pH control agent to the turbine feedwater. Although the reduction of the turbine potential to near ground reduces the chances of a damaging discharge, in some embodiments the water droplets in the exhaust need to carry some charge so that they can be atomized, which effects the condensation efficiency of the system.

The shaft current may be monitored by a variety of different techniques. One technique includes using the operational amplifier output of an active shaft grounding system (AGS) to indicate the shaft current. Another technique is to directly measure the ground current off the shaft. Still another technique is to measure the voltage on the shaft and infer the current.

These and other objects, features, and advantages in accordance with the present invention are provided particular embodiments by methods for monitoring and controlling steam turbine system pH using shaft current that comprises monitoring a current from a turbine-generator shaft to ground and inferring the charge of an exhaust passing the turbine shaft by the amount of the current to ground. A pH control agent injection unit that injects ions into a feedwater supply is then adjusted, where the feedwater supply is converted into the exhaust and where the current is kept near ground potential.

In another embodiment the present invention provides for method for monitoring and controlling steam turbine system pH using shaft current that comprises a turbine-generator shaft exposed to a charged exhaust stream, where the turbine-generator shaft has a current. An active shaft grounding system that provides an operational amplifier output to the turbine-generator shaft is installed, and the operational amplifier output is monitored. An indication of the operational amplifier output is transferred to a pH control unit and a chemical feed to a feedwater system is adjusted in an inverse proportion to the operational amplifier output, where the feedwater system ultimately produces the charged exhaust stream, and where the current is kept near ground potential while maintaining a positive charge on the charged exhaust steam.

In still another embodiment of the present invention, a method of adjusting a pH control unit in a steam turbine generator system provides for monitoring a shaft current on a low pressure turbine-generator shaft and inferring a charge of an exhaust passing the low pressure turbine based on the shaft current. A characterization of the inference of the charge of the exhaust, which could be a measurement of the current or a conversion to a digital signal or another type of characterization, is fed to the pH control unit, where the pH control unit adjusts a chemical feed to a feedwater system in an inverse proportion to the charge of the exhaust, and where the charge of the exhaust is changed based on the adjustment to the chemical feed creating a negative feedback effect on the shaft current.

Other embodiments of the present invention also exist, which will be apparent upon further reading of the detailed description.

BRIEF DESCRIPTION OF THE FIGURES

The invention is explained in more detail by way of example with reference to the following drawings.

DETAILED DESCRIPTION OF THE INVENTION

Figure 1:
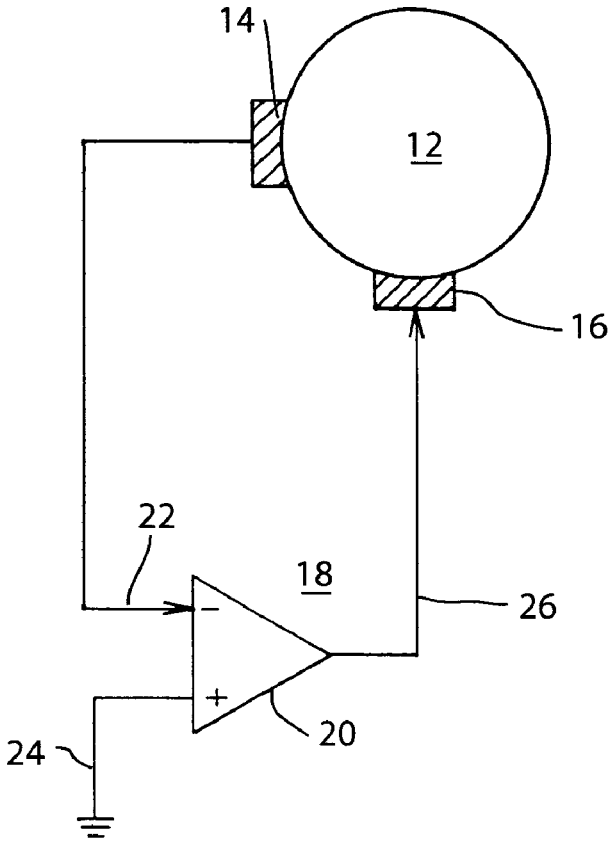
FIG. 1 PRIOR ART
FIG. 1 illustrates an AGS of the prior art.

In one embodiment the present invention provides for a system for controlling the electric charge within the exhaust hood and condenser of a steam turbine by using turbine-generator shaft current as an indirect measurement of exhaust charge. This measurement is then used to adjust the chemical feed to a feedwater system, which ultimately becomes the exhaust. In this manner the pH of the exhaust can be controlled, which in turn affects the shaft current.

Without proper adjustments of the exhaust charge, electrical discharges through bearing oil films and corrosion of the turbine will occur. The prior art determined the adjustments to the pH of the feedwater by using probes placed in the path of the steam flow to measure the current as it relates to ground. The prior art requires the physical placement of probes into the exhaust stream, which creates a system that is susceptible to failure, corrosion and can only monitor charge levels of the exhaust at specific points where the probes are located.

By using the shaft current, a known component of a power generation system is employed, since shaft current tends to be controlled for other reasons. Some examples of using the shaft current are given below. Further, by using the shaft current, the overall charge of the exhaust stream is averaged over the entire turbine, rather than just at specific probe points. This has the potential for creating a more accurate measurement of the total charge in the turbine exhaust.

The shaft current is created by the unbalanced ions in the moisture on the turbine surfaces generated by shearing the double layer on the turbine surfaces, creating charged moisture droplets in the steam flow. The charges on the moisture droplets depend on the surface chemistry and are often positive, with the corresponding negative charge remaining on the rotor. This current is used to optimize the addition of ammonia or other pH control agent to the turbine feedwater. Although the reduction of the turbine potential to near ground reduces the chances of a damaging discharge, in some embodiments the water droplets in the exhaust need to carry some charge so that they can be atomized, which effects the condensation efficiency of the system, as discussed below.

Depending on the turbine materials and the deposits that may exist on the turbine, the charge on the steam may be either positive or negative. In the case of most common materials, it will be positive, and the increase in shaft current indicates that the pH is excessive. The exact correlation between shaft current and charge on the steam/exhaust will vary from generator to generator, although an approximately linear correlation is expected for most embodiments. Therefore, the addition of chemicals to the feedwater that increase pH, such as ammonia, needs to be lowered. The drop in feedwater pH, which is ultimately converted into exhaust, will lower the shaft current. The most advantageous amount of charge in the turbine exhaust should be determined by experiment, wherein the power output of the unit is measured while the amount of ammonia or another pH controlling chemical added to the feedwater is gradually varied, as would be apparent to one of ordinary skill in the art.

An example of an optimal shaft current to ground for a typical fossil turbine generator is approximately 5-10 milliamps, with a feedwater pH of approximately 9. In some fossil turbines, the current may be higher, 20 milliamp or more. In some nuclear turbines the current may be in the 300 milliamp range.

The shaft current may be monitored by a variety of different techniques. One technique includes using the operational amplifier output of an active shaft grounding system (AGS) to indicate the shaft current. Another technique is to measure the ground current directly, although with this technique it is harder to control the charge development due to lack of a clean signal. Other techniques include using the voltage on the shaft and infer the current. As used herein, the terms shaft and turbine-generator shaft are used interchangeably. It should also be understood that although the current is measured at the shaft, the charge, and therefore the current, develops on the blading of turbine. Exhaust and steam are used interchangeably.

In a standard turbine, the AGS is present because operation of a steam turbine results in an electrical charge build-up on the rotor, or shaft, which is supported at spaced apart locations by bearings. The shaft actually rides on a thin film of lubricant in the bearing and accordingly is electrically insulated from ground potential. Since the rotating shaft is electrically isolated from the stationary portion of the machinery a potentially dangerous voltage differential may build up across oil films. If the electrical rating of the thin film of oil is exceeded, an electrical discharge may take place there through causing an arc-over, which may result in burning of the lubricating oil, pitting of the bearing material, turbulence and eventual bearing failure.

In order to reduce this there is provided a method for maintaining shaft at an electrical ground potential. This is accomplished with the provision of a grounding device electrically connecting the shaft to a pedestal structure, or any other stationary portion of the turbine at ground potential, so as to establish an electric current discharge path between the rotary and stationary portions of the turbine. This is referred to as an active shaft grounding system (AGS).

FIG. 1 illustrates a typical AGS system. A first electrical contact brush 14 and a second electrical contact brush 16, both make contact with shaft 12 as it rotates. Connected between the first and second brushes is a feedback circuit 18 which provides a neutralizing current at the second brush 16 to prevent or minimize any electrical charge build-up on the shaft 12, as a function of the voltage appearing at the first brush 14. The feedback circuit 18 includes an operational amplifier (op amp) 20 having a first or inverting input 22 connected to receive the voltage at the first brush 14, and a second or non-inverting input 24 connected to a reference potential illustrated as ground. The output 26 of op amp 20 is connected to the second brush 16 for delivery of the neutralizing current. With a high open loop gain of op amp 20, the shaft 12 will be maintained near ground potential.

Figure 2:
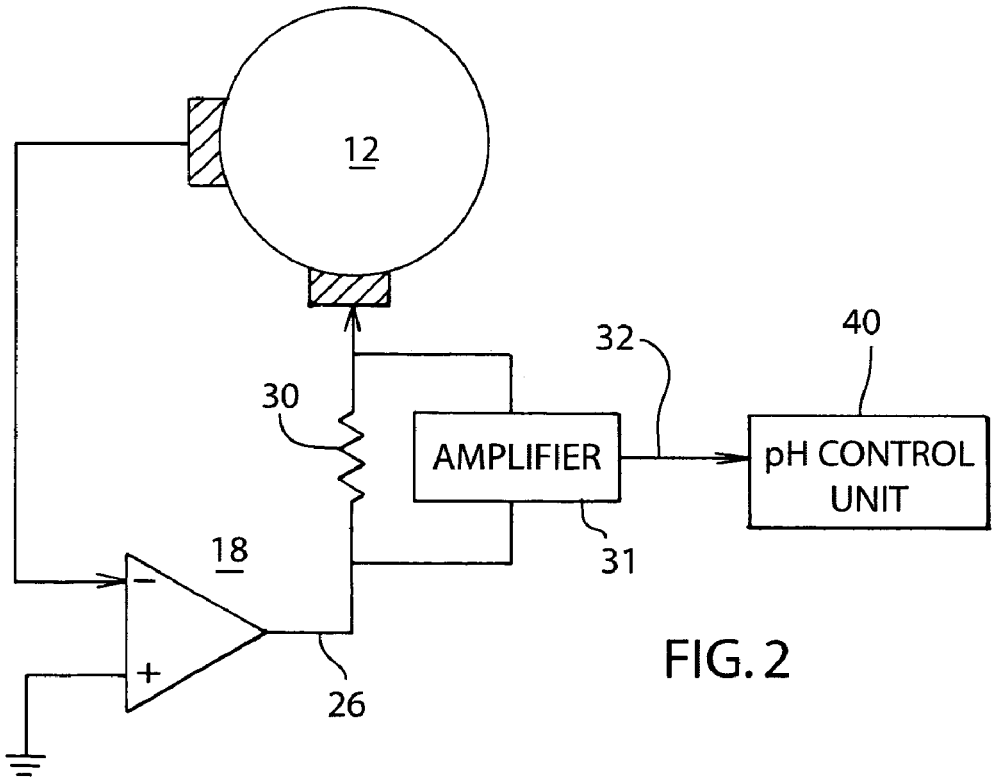
FIG. 2 illustrates one embodiment of monitoring shaft current to feed into pH control.

Referring to FIG. 2, an example is given of how the op amp output 26 is measured, which in this embodiment utilizes an amplifier 31. This information 32 is fed into a pH control unit 40 that is part of a turbine system (not shown). In this embodiment the voltage across a resistor 30 is used in measuring the op amp current output 26, although other technique could also be used. The signal 32 sent to the pH control unit may be a direct electrical signal, or it could be a converted digital signal.

Figure 3:
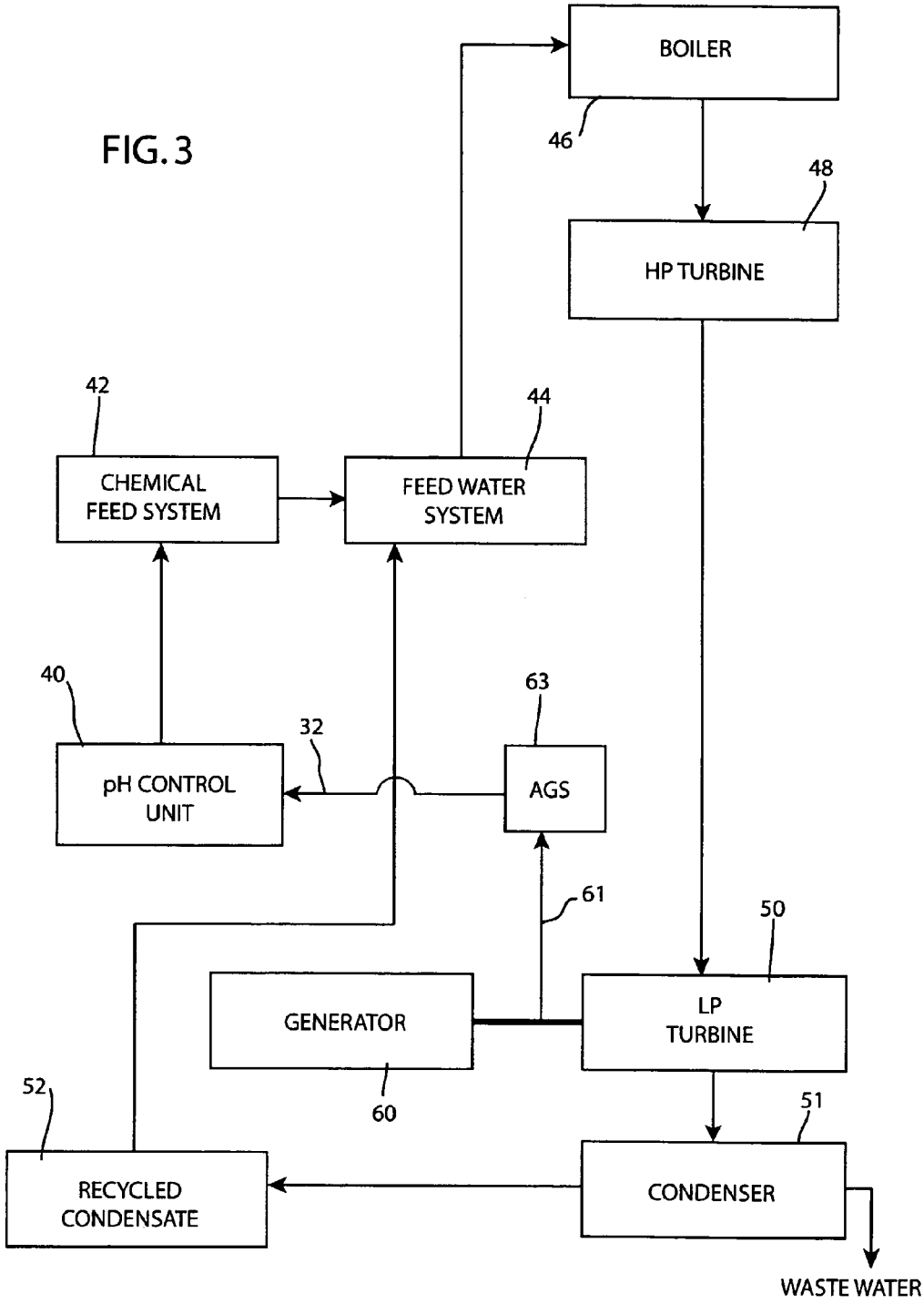
FIG. 3 illustrates one embodiment of an overview of the present invention.

FIG. 3 shows a schematic overview of how the present invention is employed within a power generation system.

Feedwater 44 is fed into a boiler, which converts it into a steam exhaust that is run through a series of turbines, such as a high pressure (HP) turbine 48 and a low pressure (LP) turbine 50, although exact configurations may vary. The bulk of the steam is condensed in a condenser 51 and the condensate is recycled 52 back into the feedwater system. The current of the generator rotor shaft, which is located between the generator 60 and turbine 50, at the turbine end, is sensed 61, is then measured in the AGS 63 as described above, and this measurement 32 is then fed into a pH control unit 40 that controls a chemical feed 42 into the feedwater.

As illustrated, the shaft current will tend to be taken from the generator shaft at the turbine end because the AGS functions to control the generator dissymmetry current. However, for controlling the electrostatic current, it is possible to measure the current from any of the shafts in the system, since the shafts are in electrical contact. In FIG. 3, the pH control unit 40 and the chemical feed system 42 are shown as separate entities. These systems may be combined in some embodiments, and may also be combined with other generator equipment.

By taking accurate and non-invasive inferred measurements of exhaust charge, the power generation system can be better optimized. This results in not only a more efficient power generation system, but also a system that produces less waste in the form of wasted heat and excessive chemical feed loss.

Although keeping ion addition to the feedwater, hence exhaust, as low as possible is desirable to reduce discharges and corrosion, some systems rely on some amount of feedwater pH elevation. For example, most systems require that the feedwater pH be kept above 8, although this is system dependant.

In addition, it is useful in steam turbines to reduce the amount of water vapor present in the steam exhaust, and one of the primary mechanisms for doing this is having water vapor condense on water droplets present in the exhaust. Water droplets coming off of a turbine tend to be comparatively large (0.001 cm diameter) and therefore provide comparatively small surface area to volume. In place in steam turbines may be systems that use the electrical potential between alternating grounding and active electrodes to atomize positively charged water droplets within a steam turbine.

The atomized water droplets provide a much greater surface area to volume ratio, and thereby providing greater condensation for the water vapor in the exhaust. The electrical potential between alternating grounding and active electrodes needs to be a certain current (e.g. +20 kV) above ground. In addition to that, the water droplets need a sufficient (positive) charge to be atomized. Therefore maintaining some positive charge to the exhaust is necessary for this sub-system to function.

In one embodiment the present invention provides for a method for monitoring and controlling steam turbine system pH using shaft current that comprises monitoring a current from the turbine-generator shaft to ground and inferring the charge of an exhaust passing the turbine rotor by the amount of the current to ground. A pH control agent injection unit that injects ions into a feedwater supply is then adjusted, where the feedwater supply is converted into the exhaust and where the current is kept near ground potential.

In a related embodiment the monitoring of the current comprises monitoring an output of an operational amplifier to the turbine-generator shaft, and the operational amplifier output is measured using a resistor and an amplifier circuit. In some embodiments the monitoring of the current comprises monitoring a ground current of the shaft, while in other the monitoring of the current comprises monitoring the shaft voltage and inferring the current.

In other embodiments the adjustment of the pH control agent injection maintains a positive charge on water droplets suspended in the exhaust, by keeping feedwater pH 8 and above. The pH control agent injection unit may inject ammonia into the feedwater supply, and the pH control agent injection can be comprised pH control unit and a chemical feed system.

In another embodiment the present invention provides for method for monitoring and controlling steam turbine system pH using shaft current that comprises a turbine-generator shaft exposed to a charged exhaust stream, where the turbine-generator shaft has a current. An active shaft grounding system that provides an operational amplifier output to the turbine-generator shaft is installed, and the operational amplifier output is monitored. An indication of the operational amplifier output is transferred to a pH control unit and a chemical feed to a feedwater system is adjusted in an inverse proportion to the operational amplifier output, where the feedwater system ultimately produces the charged exhaust stream, and where the current is kept near ground potential while maintaining a positive charge on the charged exhaust steam.

In a related embodiment, the adjustment of the chemical feed to the feedwater system is made until the operational amplifier output is approximately 5 milliamps. The pH of the charged exhaust stream is maintained above pH 8, such as at approximately pH 9. The operational amplifier output may be measured using a resistor and an amplifier circuit, and the turbine-generator shaft may be part of a generator.

In still another embodiment of the present invention, a method of adjusting a pH control unit in a steam turbine generator system provides for monitoring a shaft current on a low pressure turbine and inferring a charge of an exhaust passing the low pressure turbine based on the shaft current. A characterization of the inference of the charge of the exhaust, which could be a measurement of the current or a conversion to a digital signal or another type of characterization, is fed to the pH control unit, where the pH control unit adjusts a chemical feed to a feedwater system in an inverse proportion to the charge of the exhaust, and where the charge of the exhaust is changed based on the adjustment to the chemical feed creating a negative feedback effect on the shaft current.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the inventions which, is to be given the full breadth of the claims appended and any and all equivalents thereof.

What is claimed is:

1. A method for monitoring and controlling steam turbine system pH using shaft current comprising:

monitoring a current from a turbine-generator shaft to ground;

inferring the charge of an exhaust passing said turbine-generator shaft by the amount of said current to ground, wherein the PH level of said exhaust is correlated to said charge of said exhaust, and the PH level of said exhaust is thereby inferred by measuring said amount of current to ground on said turbine-generator shaft, and wherein no probes are in direct physical contact with said exhaust;

adjusting a pH control agent injection unit that injects ions into a feedwater supply, wherein said feedwater supply is converted into said exhaust;

wherein said current is kept near ground potential.

2. The method of claim 1, wherein the monitoring of said current comprises monitoring an output of an operational amplifier to said turbine-generator shaft.

3. The method of claim 2, wherein said operational amplifier output is measured using a resistor and an amplifier circuit.

4. The method of claim 1, wherein the monitoring of said current comprises monitoring a ground current of said shaft.

5. The method of claim 1, wherein the monitoring of said current comprises monitoring the shaft voltage and inferring the current.

6. The method of claim 1, wherein the adjustment of said pH control agent injection maintains a positive charge on water droplets suspended in said exhaust.

7. The method of claim 1, wherein said pH control agent injection unit injects ammonia into said feedwater supply.

8. The method of claim 1, wherein said pH control agent injection comprises a pH control unit and a chemical feed system.

9. The method of claim 1, wherein said turbine-generator shaft is a generator shaft.

10. A method for monitoring and controlling steam turbine system pH using shaft current comprising:

a turbine-generator shaft exposed to a charged exhaust stream, wherein said turbine-generator shaft has a current;

installing an active shaft grounding system that provides an operational amplifier output to said turbine-generator shaft;

monitoring said operational amplifier output;

directing an indication of said operational amplifier output to a pH control unit, wherein said indication of said operational amplifier output directly correlates to the pH of said charged exhaust stream;

adjusting a chemical feed to a feedwater system, in an inverse proportion to said operational amplifier output, wherein said feedwater system ultimately produces said charged exhaust stream;

wherein said current is kept near ground potential while maintaining a positive charge on said charged exhaust steam.

11. The method of claim 10, wherein the adjustment of said chemical feed to said feedwater system is made until said operational amplifier output is approximately 5 milliamps.

12. The method of claim 10, wherein the pH of said charged exhaust stream is maintain at approximately pH 9.

13. The method of claim 10, wherein said operational amplifier output is measured using a resistor and an amplifier circuit.

14. The method of claim 10, wherein said turbine-generator shaft is part of low pressure turbine in a steam turbine generator.

15. A method of adjusting a pH control unit in a steam turbine generator system comprising:

monitoring a shaft current on a turbine-generator;

inferring a charge of an exhaust passing said low pressure turbine based on said shaft current, wherein said charge of said exhaust is directly correlated to the pH of said exhaust, and wherein no probes are in direct physical contact with said exhaust;

feeding a characterization of the inference of said charge of said exhaust to said pH control unit, wherein said pH control unit adjusts a chemical feed to a feedwater system in an inverse proportion to said charge of said exhaust;

wherein said charge of said exhaust is changed based on the adjustment to said chemical feed creating a negative feedback effect on said shaft current.

* * * * *